US005316535A

United States Patent [19]

Bradbury

[11] Patent Number: 5,316,535

[45] Date of Patent: May 31, 1994

[54] UNIVERSAL EXERCISE APPARATUS

[76] Inventor: Ray Bradbury, 500 E. Fairmount Rd., Burbank, Calif. 91501

[21] Appl. No.: 937,117

[22] Filed: Sep. 21, 1992

[51] Int. Cl.[5] ..... A63B 21/00

[52] U.S. Cl. ..... 482/135; 482/54; 482/114; 482/908

[58] Field of Search ..... 482/114, 119, 120, 101, 482/54, 135, 136, 138; 198/861.5

[56] References Cited

U.S. PATENT DOCUMENTS

| | | | |
|---|---|---|---|
| 641,519 | 1/1900 | Kerns | 482/119 |
| 3,206,003 | 9/1965 | Orr | 198/861.5 |
| 3,741,538 | 6/1973 | Lewis et al. | 482/120 |
| 3,885,789 | 5/1975 | Deluty et al. | 482/120 |
| 4,562,921 | 1/1986 | Lecmkuil et al. | 198/841 |
| 4,723,774 | 2/1988 | Montorte | 482/72 |
| 4,822,029 | 4/1989 | Sarno et al. | 482/120 |
| 4,907,797 | 3/1990 | Gezari et al. | 482/135 |
| 4,919,238 | 4/1990 | Skipper | 482/120 |
| 5,060,938 | 10/1991 | Hawley, Jr. | 482/119 |

FOREIGN PATENT DOCUMENTS

| | | | |
|---|---|---|---|
| 1291165 | 2/1987 | U.S.S.R. | 482/120 |
| 1358973 | 12/1987 | U.S.S.R. | 482/120 |

*Primary Examiner*—Richard J. Apley
*Assistant Examiner*—Jeanne M. Mollo
*Attorney, Agent, or Firm*—Roger A. Marrs

[57] ABSTRACT

An exercise apparatus on which a wide variety of body exercises can be performed is disclosed herein having a base supporting an upright frame with a movable carriage traveling between guide tracks. The frame further supports an adjustable tension mechanism operably connected to the carriage for providing a resistance force against which the user applies muscle pressure. A handle is attached to the carriage and the carriage is movably mounted to the frame. Hand grips are coupled to the adjustable tension mechanism for use without the carriage and the base includes a first section supporting the frame and a second section for supporting the user or an incline bench. By orientation of the frame in a vertical or a horizontal position and by selected use of the carriage, various groups of muscle may be selectively exercised.

1 Claim, 7 Drawing Sheets

FIG. 8.
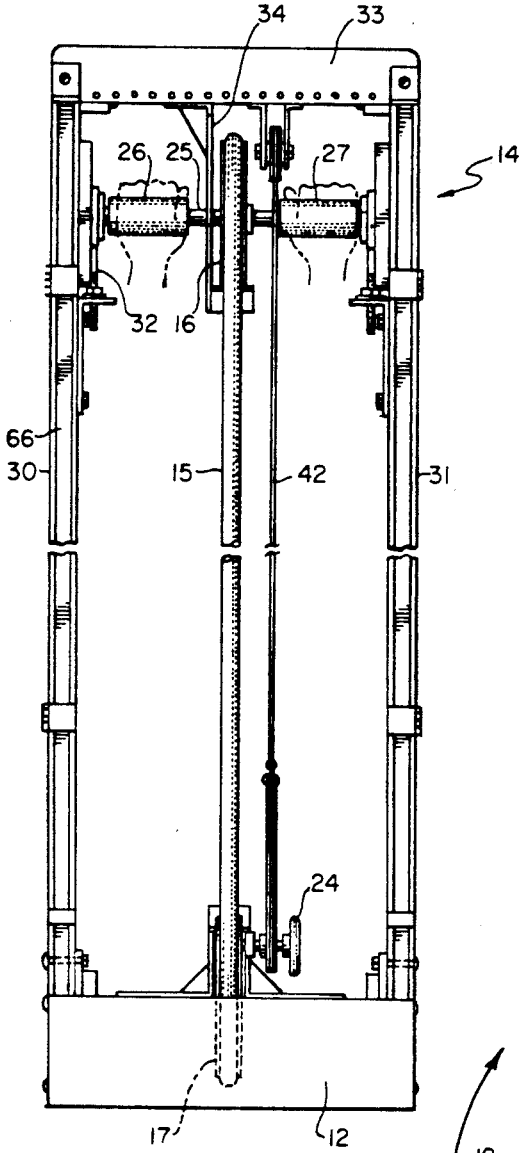
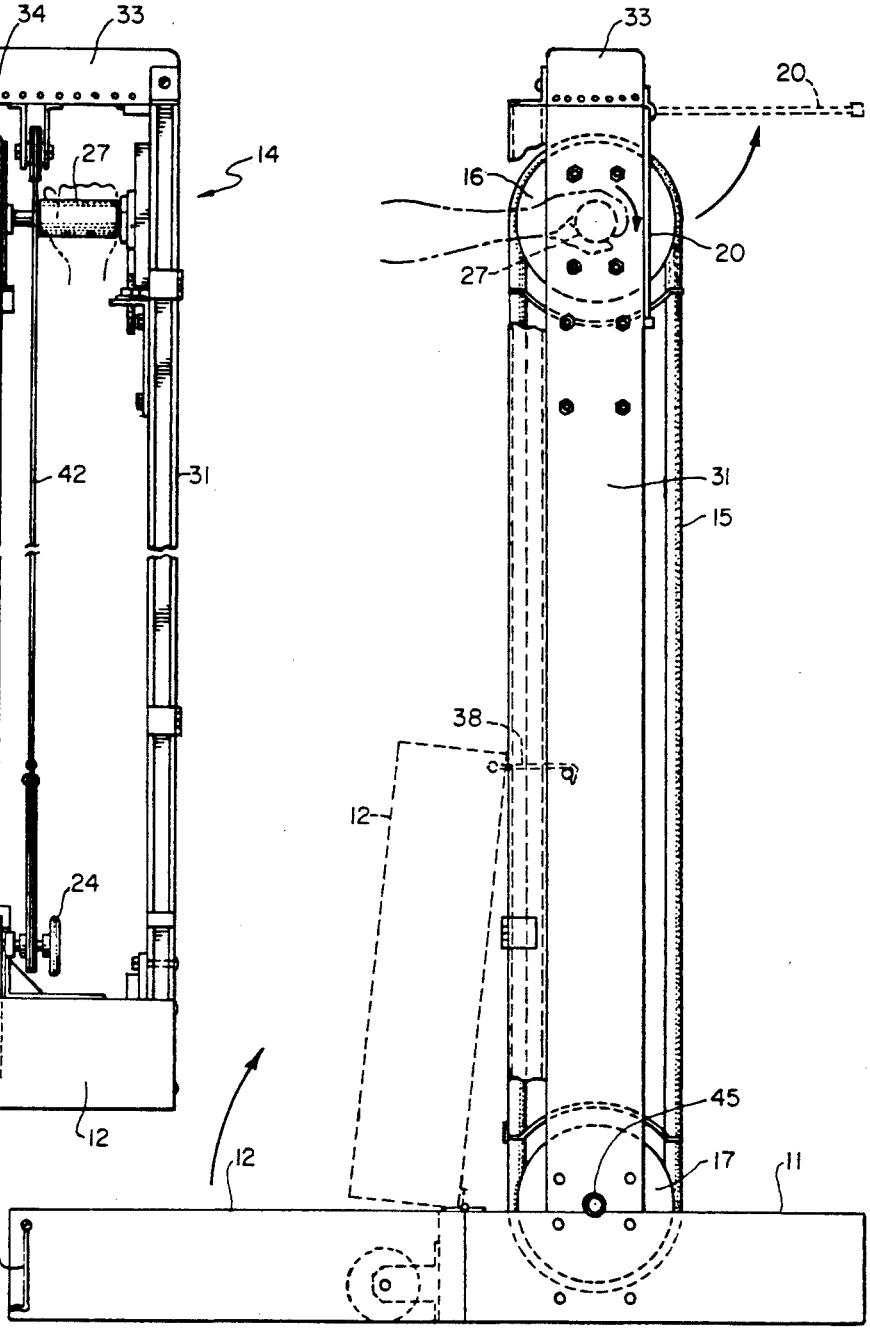
FIG. 7.

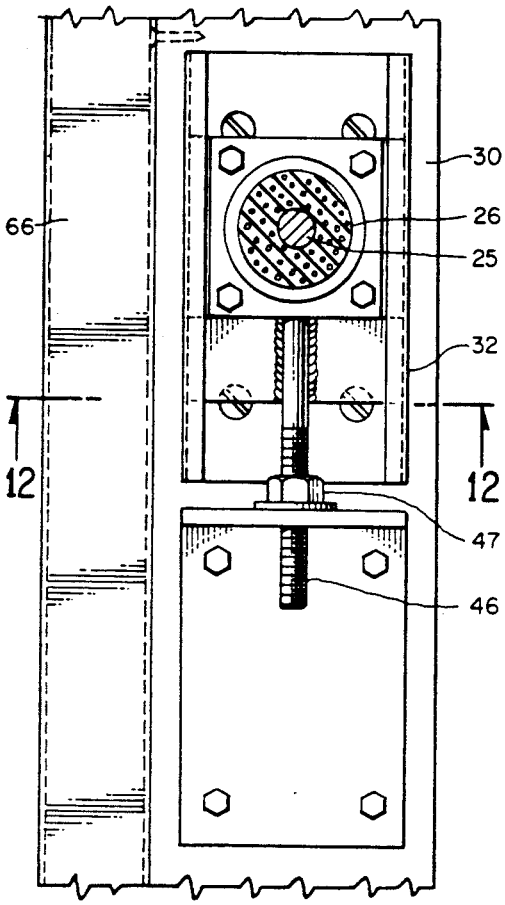
FIG. 11.
FIG. 12.
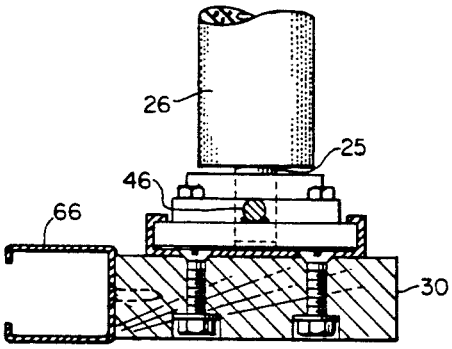
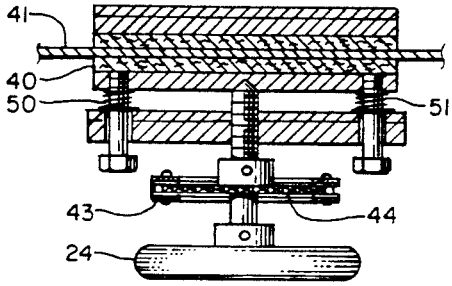
FIG. 13.
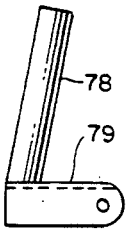
FIG. 16.
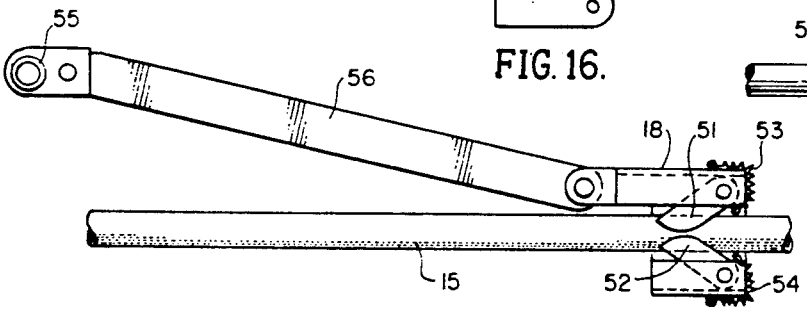
FIG. 14.
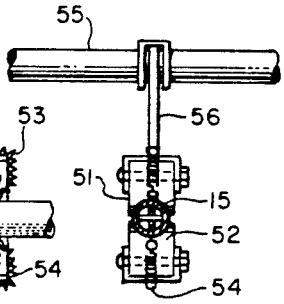
FIG. 15.

FIG. 17.
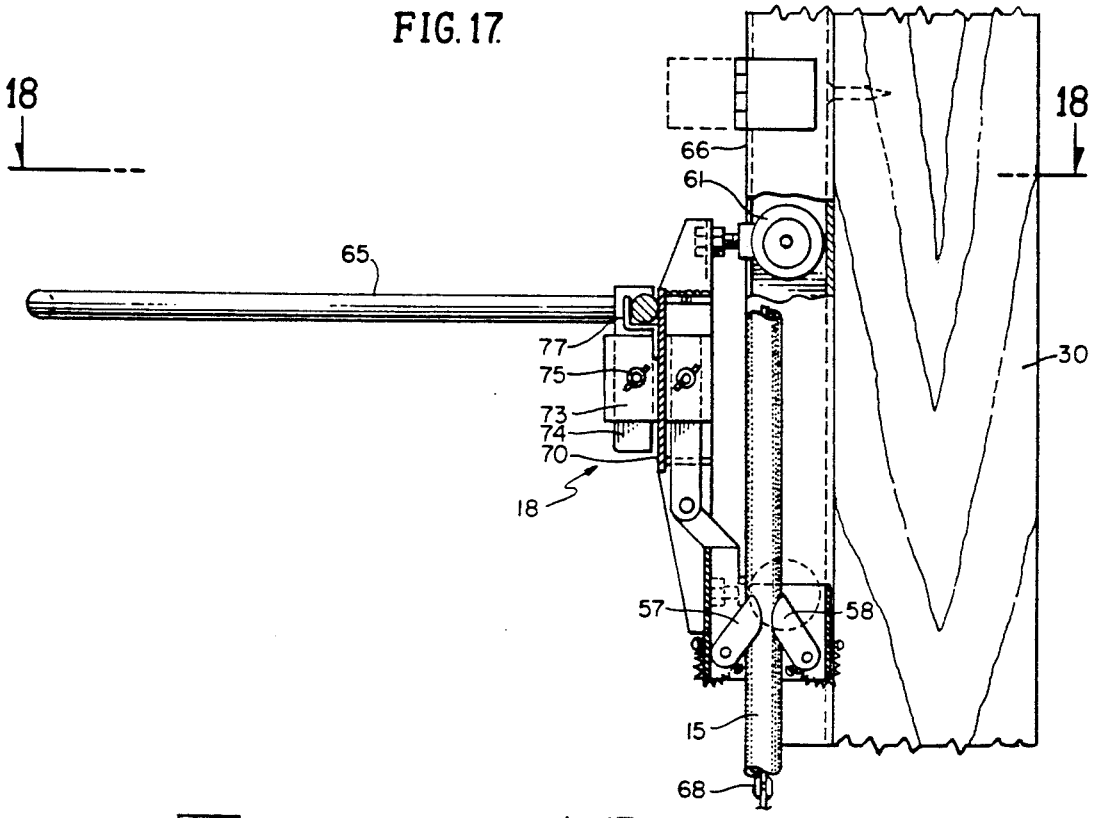
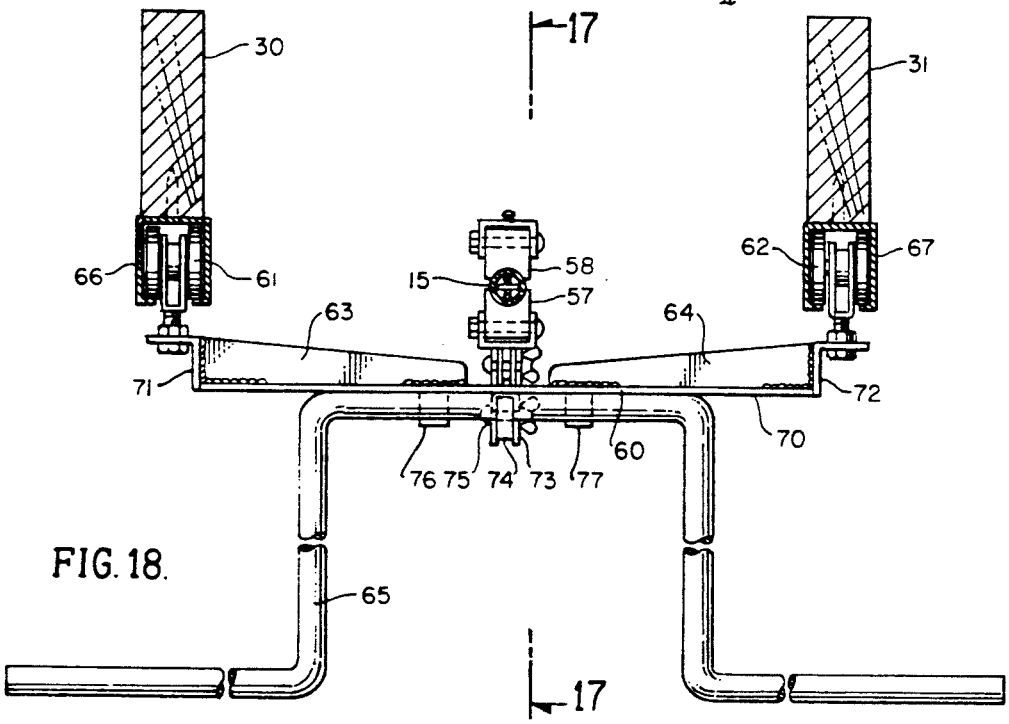
FIG. 18.

UNIVERSAL EXERCISE APPARATUS

BACKGROUND OF THE INVENTION

1. Field of the Invention

The present invention relates to the field of exercising apparatus as taken in the direction of arrows 17—17 of FIG. 18 and more particularly to a novel exercising unit having multiple stations by which various muscles and muscle groups of the body can be selectively exercised and wherein the apparatus includes an adjustable tension means coupled to a movable carriage and to operable hand grips on a frame which is pivotally carried on a base susceptible for use in a horizontal or a vertical orientation.

2. Brief Description of the Prior Art

In the past, it has been the conventional practice to employ a variety of exercise equipment in order to exercise and condition selected groups of muscles of the body. In some instances, a single apparatus may be used for more than one group; however, no machine appears to be available which will exercise all of the muscles in the body. In this connection, such a device must be susceptible for conversion from one station to another by employing alternate equipment sections or portions so that the exercising unit is versatile and adaptable to accommodate the user when exercising different body areas. Some attempts have been made to provide such a device, which requires expensive and multiple parts for achieving their intended purpose. Obviously, the size, expense and complexity are greatly increased so that such prior apparatus is not in wide use.

Therefore, a long-standing need has existed to provide a novel universal exercising device which may provide the user with a choice of performing selected exercises by interchanging a variety of parts to the equipment so that selected muscle groups or muscles can be exercised. Such a device must be susceptible for use orientation in a vertical or in a horizontal position in order to effect wide and selected use.

SUMMARY OF THE INVENTION

Accordingly, the above problems and difficulties are obviated by the present invention which provides a base for supporting an upright frame at a 90 degree angle wherein the base further includes a pivoted section so that the upright frame may be readily positioned to alternate operating positions between a vertical and a horizontal disposition. The frame includes a movable carriage that is movably carried on guides between upright stanchions or sides of the frame and further includes an adjustable tensioning means releasably connected to the carriage for adjusting the tension needed to move the carriage on the frame. Additionally, hand grips are operably carried on the frame and connected to the adjustable tension means for alternate use to the carriage.

Therefore, a primary object of the present invention is to provide a novel exercising apparatus that is usable in different configurations and orientations for selectively exercising a variety of body muscle groups.

Yet another object of the present invention is to provide a novel exercising apparatus for exercising different body groups without the necessity of cams or other devices limiting the extent of muscle working and which includes a selection of components that may be added to the basic machine in order to accomplish exercise of the various body groups of muscles.

Still another object of the present invention is to provide a novel universal exercise machine which is basically in one manufactured piece and which may incorporate a variety of optional components in order to convert the apparatus into tensioning equipment or means for exercising a variety of body muscles.

Another object of the present invention is to provide an exercising device which is relatively inexpensive to manufacture, easy to use and which may be converted between alternate positions in order to effectuate usage for exercising a variety of body muscle groups.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 8 is a front elevational view of the apparatus shown in FIG. 1 in its vertical position;

FIG. 7 is a side elevational view of the apparatus shown in FIG. 8;

FIG. 11 is a sectional view illustrating the hand grip component of the inventive machine or apparatus;

FIG. 12 is a cross-sectional view of the hand grip component as taken in the direction of arrows 12—12 of FIG. 11;

FIG. 13 is a transverse cross-sectional view of the apparatus tension mechanism taken in the direction of arrows 13—13 of FIG. 9;

FIG. 14 is a side elevational view showing the releasable clamping means for hand grips or hand bar handles as used in the present invention;

FIG. 15 is a front elevational view of the hand grips shown in FIG. 14;

FIG. 16 is a side elevational view of a connector as used in the handle bar arrangement shown in FIG. 14;

FIG. 17 is a cross-sectional view of the movable carriage used on the apparatus;

FIG. 18 is a cross-sectional view of the carriage shown in FIG. 17 as taken in the direction of arrows 18—18 thereof.

DESCRIPTION OF THE PREFERRED EMBODIMENT

Figure 1:
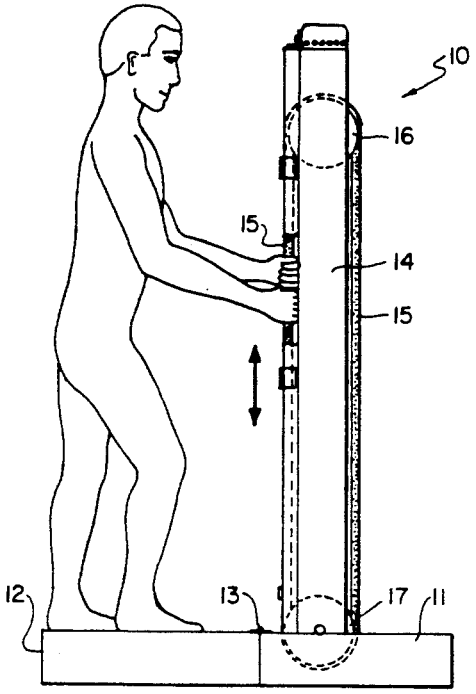
FIG. 1 is a side elevational view of the exercising apparatus of the present invention illustrating the user employing the device for arm and shoulder exercises.

Referring to FIG. 1, the novel exercising device of the present invention is illustrated in the general direction of arrow 10 which includes a base 11 having an extensions base 12 pivotally attached thereto by means of a hinge 13. Therefore, the base extension 12 may be raised to a vertical position or may be lowered to the horizontal position, as shown in FIG. 1, so that the extension and the main base are coextensive. The device 10 further includes an upright frame 14 for operably supporting an adjustable tension mechanism which includes an endless cable 15 which is trained about wheels 16 and 17. Pulley wheel 17 is rotatably attached to the main base 11 while the pulley wheel 16 is rotatably carried on the upper end of the frame 14 from its end attached to the base 11 in fixed spaced-apart relationship with respect to pulley wheel 17. The user of the device is illustrated standing on the extension base 12 and gripping the cable 15 with his hands so that the cable may be pulled up or down in order to exercise the arms and upper torso of the user.

Figure 2:
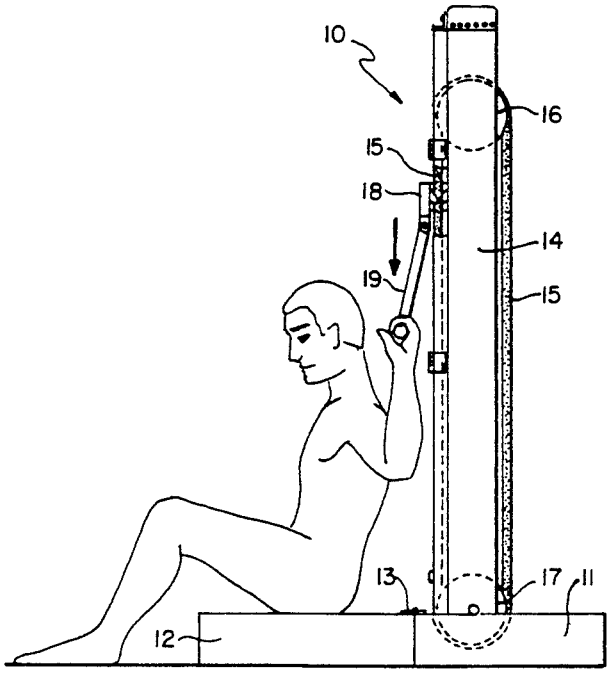
FIG. 2 is a view similar to the view of FIG. 1 illustrating the user employing a movable carriage for exercising shoulder muscles.
Figure 3:
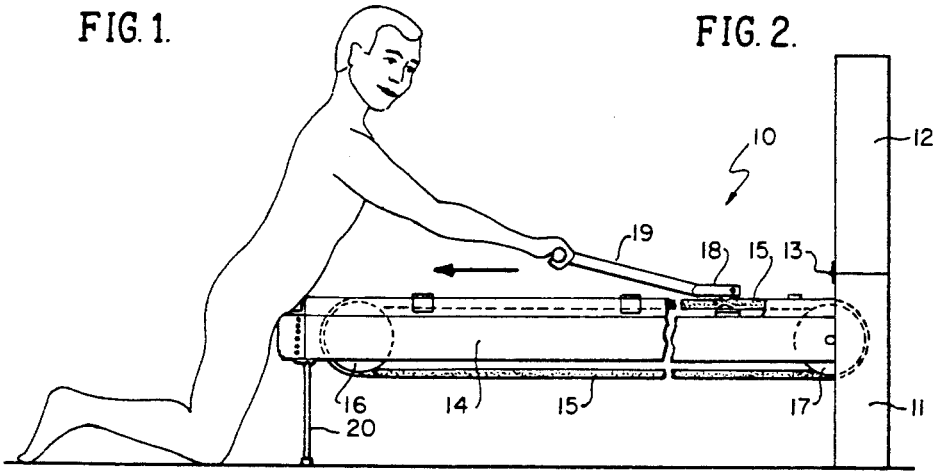
FIG. 3 illustrates the exercising device in a horizontal position with the user exercising arm and back muscle groups.

As seen if FIGS. 2 and 3, the base comprises a first supporting means including a bottom surface and side edges perpendicular to the bottom surface, and the frame includes a first end intermediately connected to the base and a second supporting means at a second end. The first and second supporting means are adapted so that when the device is in a first operative formation the bottom surface of the first supporting means contacts a horizontal supporting surface and the second supporting means is inoperative, and when the device is in a second operative formation one side edge of the first supporting means and the second supporting means contact the horizontal supporting surface.

Referring to FIG. 2, the versatility of the device is further illustrated by the inclusion of a carriage 18 with handle bars 19 detachably connected to the cable 15. When the handle bar cable is included, the user may sit on the extension base 12 and by gripping the handle bars 19, the user may exert a downward pull against the tension placed on the cable to exercise the upper body group muscles such as the deltoids and triceps.

FIG. 3 illustrates another use of the apparatus wherein the main base 11 is placed on its end with the extension base 12 extending in a vertical manner so that the frame 14 is in a horizontal orientation. A brace 20 is employed for supporting the normally cantilevered or upper end of frame 14 on a supporting floor. In this orientation, the user may grasp the handle bars of the carriage 18 and do pulling exercises to exercise upper torso muscles including the back muscles.

Figure 4:
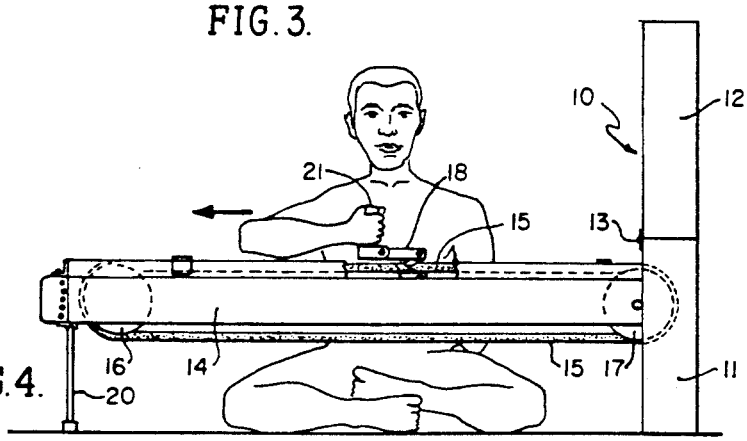
FIG. 4 is a view similar to the view of FIG. 3 showing the user exercising arm group muscles.

Referring to FIG. 4, another use of the apparatus is illustrated in which a hand grip is employed to replace the handle bars on the carriage 18. The hand grip is indicated by numeral 21 and is grasped by one hand of the user and is moved across the front of the user, as indicated by the arrow.

Figure 5:
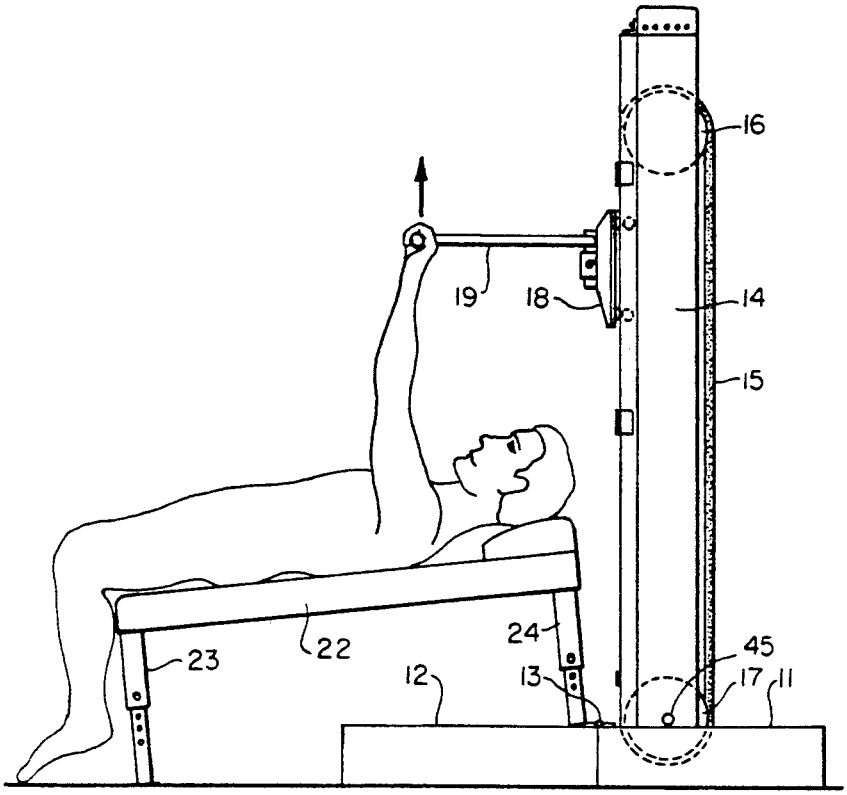
FIGS. 5 and 6 illustrate the apparatus in a verticle position with the movable carriage so as to provide exercising movements for the user's chest muscle groups.

In FIG. 5, an inclined bench 22 is placed so that one end is on the floor, as represented by numeral 23, while the opposite support 24 is supported on the extension base 12. The height of the bench may be readily selected by means of the telescoping supports 23 and 24 wherein aligned holes in the telescoping arrangement are passed through by a retaining pin to effect retention. In this position, the user can grasp the handle bar 19 and move the carriage 18 in a similar fashion to that shown in FIG. 2. This exercise will tone and exercise the user's chest and arm muscles.

Figure 6:
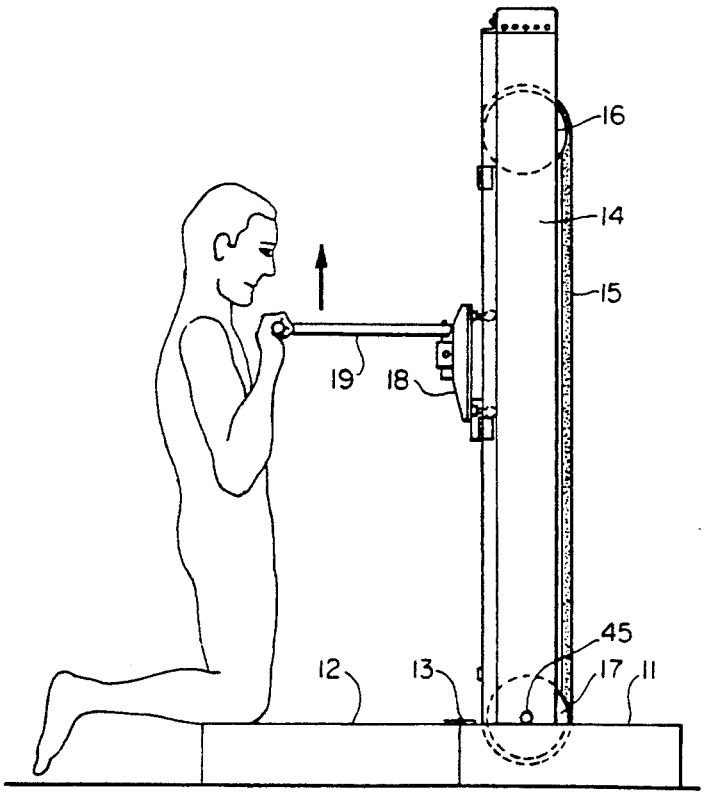

In FIG. 6, the user may place his knees on the extension base 12 while grasping the handle bars 19 and forcibly urge the carriage 18 in a vertical direction against the tension placed on the cable 15.

Referring now in detail to FIGS. 7 and 8, it can be seen that the pulley wheel 17 includes a tensioning mechanism, to be described later, which includes an adjustment wheel 24 that operates a shoe against a plate in order to adjust the resistance of the tension on the cable 15. Also, it is illustrated that the upper pulley wheel 16 is rotatably mounted on a shaft 25 on which hand grips 26 and 27 are placed on opposite sides of the cable 15. The user's hands are shown in broken lines as grasping the grips 26 and 27 whereby the wrist and arm muscles are exercised by rotating shaft 25 against the tension of the mechanism placed on cable 15. The shaft 25 may be located between a pair of stanchions 30 and 31 of the frame 14 by means of adjustment bolt and screw arrangement, broadly indicated by numeral 32. A similar bolt and screw arrangement is employed on the other side of the shaft 25 in connection with upright stanchion 31. A cross member 33 joins the ends of the stanchions 30 and 31 together and provides a downward depending bracket 34 which supports a safety guard. In FIG. 7, the bracket 20 is illustrated in its extended position in broken lines and in its stowed position in solid lines. Also, it can be seen that the extension base 12 can be pivoted on its hinge 13 to a stowed position shown in broken lines wherein a hook 38 is employed in combination with a catch on the frame upright 31 to maintain the extension base in its stowed position.

Figure 9:
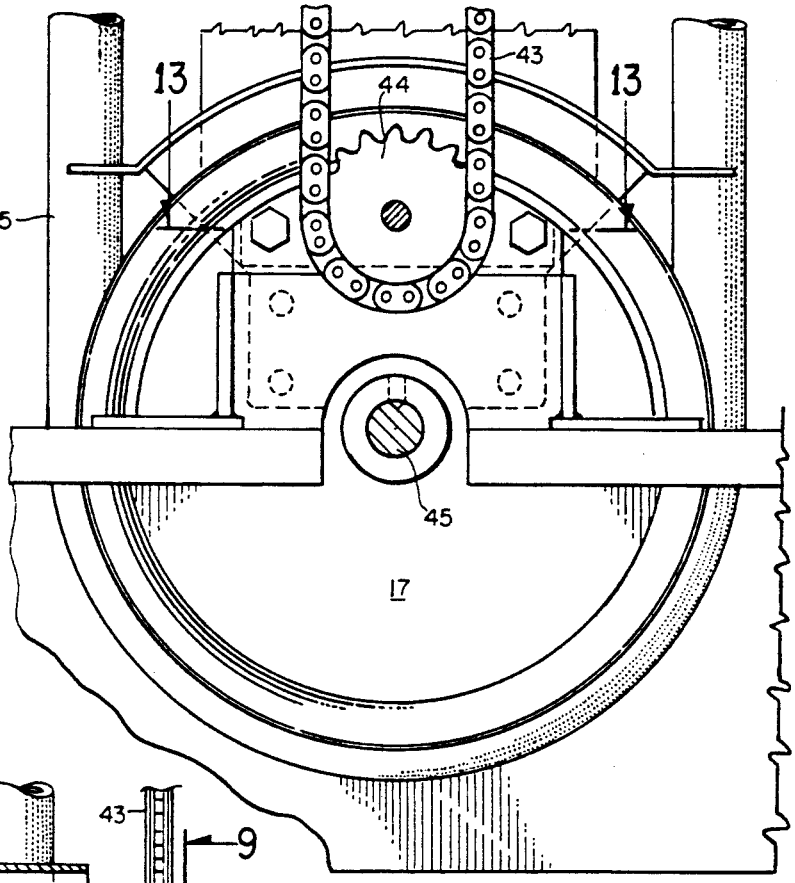
FIG. 9 is an enlarged fragmentary view showing the adjustable tension mechanism used in the apparatus as taken in the direction of arrows 9—9 of FIG. 10.
Figure 10:
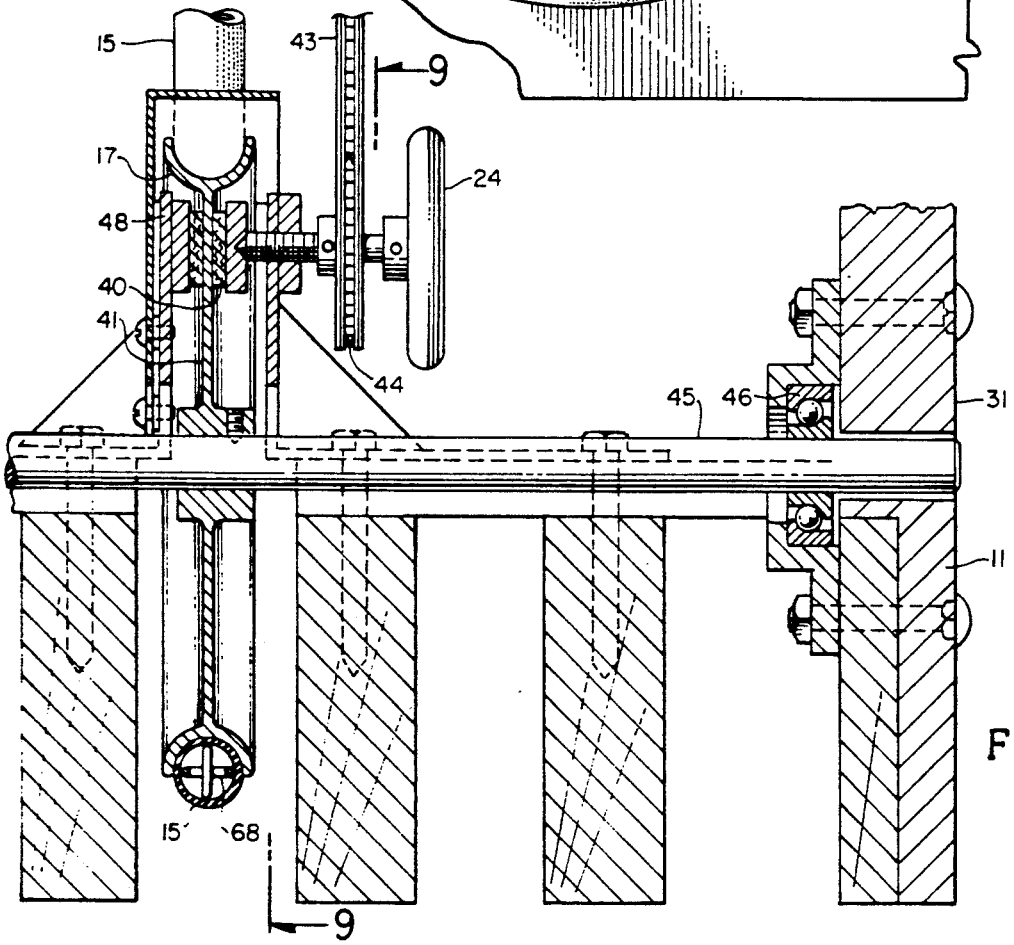
FIG. 10 is a cross-sectional view of the adjustable tension apparatus.

Referring to FIGS. 9 and 10, the tensioning mechanism for the endless cord 15 is illustrated and it can be seen that as the wheel 24 is rotated, a pad 40 is drawn into frictional engagement with a shoe 41 forming a part of the pulley wheel 17. As the pad 40 is drawn away from the wheel 17, friction is reduced and tension is reduced on the cable or cord 15. The user of the device may readily adjust tension not only by manually rotating wheel 24 but by pulling on a cord 42 as shown in FIG. 8, which is attached to a chain 43 coupled to a gear wheel 44. When the cord and chain are rotated, the shaft on which the adjustment wheel 24 is attached will rotate to draw the pad 40 into engagement with the web of the wheel 17 or will relieve the friction accordingly. It is also to be noted that the wheel 17 is attached to a rotating shaft 45 having its opposite ends carried on the respective upright stanchions 30 and 31 via bearings such as bearing 48, as shown in FIG. 10. Additionally, the adjustment mechanism is carried on a yoke-type bracket 49 which is carried on the base 11.

With respect to FIG. 11, it can be seen that the handle grips are mounted near the top of the frame between the upper end of the upright stanchions immediately under the crossbar 33. Adjustment can be made on the hand grips by moving the mounts for the hand grips in an upwardly direction by means of a threaded shank 46 and a nut 47 on which the shank is rotatably carried. By adjusting this threaded relationship, the shaft 25 can be moved up and down on the mounting bracket.

FIG. 12 more clearly shows the adjustment relationship for the hand grip 26 which is identical to the adjustment on the opposite side for hand grip 27.

Referring to FIG. 13, the cable or cord 15 adjustment further shows that the mounting for the pad 40 is on a floating relationship by means of the springs 50 and 51.

With respect to FIGS. 14 and 15, the carriage with handle bars is illustrated and the attachment means includes a spring-biased pair of elements 51 and 52 which are caused to frictionally engage with the exterior of the cable 15 on opposite sides thereof by means of springs 53 and 54 respectively. The elements 51 and 52 are drawn into a tight relationship with the cable 15 when the carriage is moved or pushed into one direction. Release is achieved when pushed in the opposite direction.

FIG. 16 illustrates a hand grip which may be used when the device is used as shown in FIG. 4 which includes a grip 78 carried on a bracket 79 that may be detachably connected to the carriage 18.

FIGS. 14 and 15 also show that the handle bars are indicated by numeral 55 and that the handle bars are connected to the carriage 18 by means of extension 56. The arrangement shown in FIG. 14 is useful in exercising the body torso and arms, as illustrated in FIG. 3.

As illustrated more clearly in FIG. 17, the carriage may be provided for doing exercises as shown in FIGS. 5 and 6 wherein the carriage 18 includes cord or cable connecting elements 57 and 58 which are spring-biased to grasp onto the external surface of the cable 15. However, the grasping elements are carried on one end of a movable carriage 60 as shown in FIG. 18, which includes rollers 61 and 62 arranged on opposite sides of the carriage and which are reinforced by brackets 63 and 64. The respective grasping elements 57 and 58 are arranged midway between the opposite ends of the carriage 60 and the respective handle bars, which take the form of a U-shaped member, are indicated by numeral 65. The rollers 61 and 62 ride in a track 66 and 67.

FIGS. 17 and 18 also disclose that the cable or cord 15 may be composed of an endless chain, as indicated by numeral 68, which is covered by a canvass sleeve, plastic coating or other hand-grasping material In some instances, even a hose can be employed through which the chain 68 is threaded.

Figure 19:
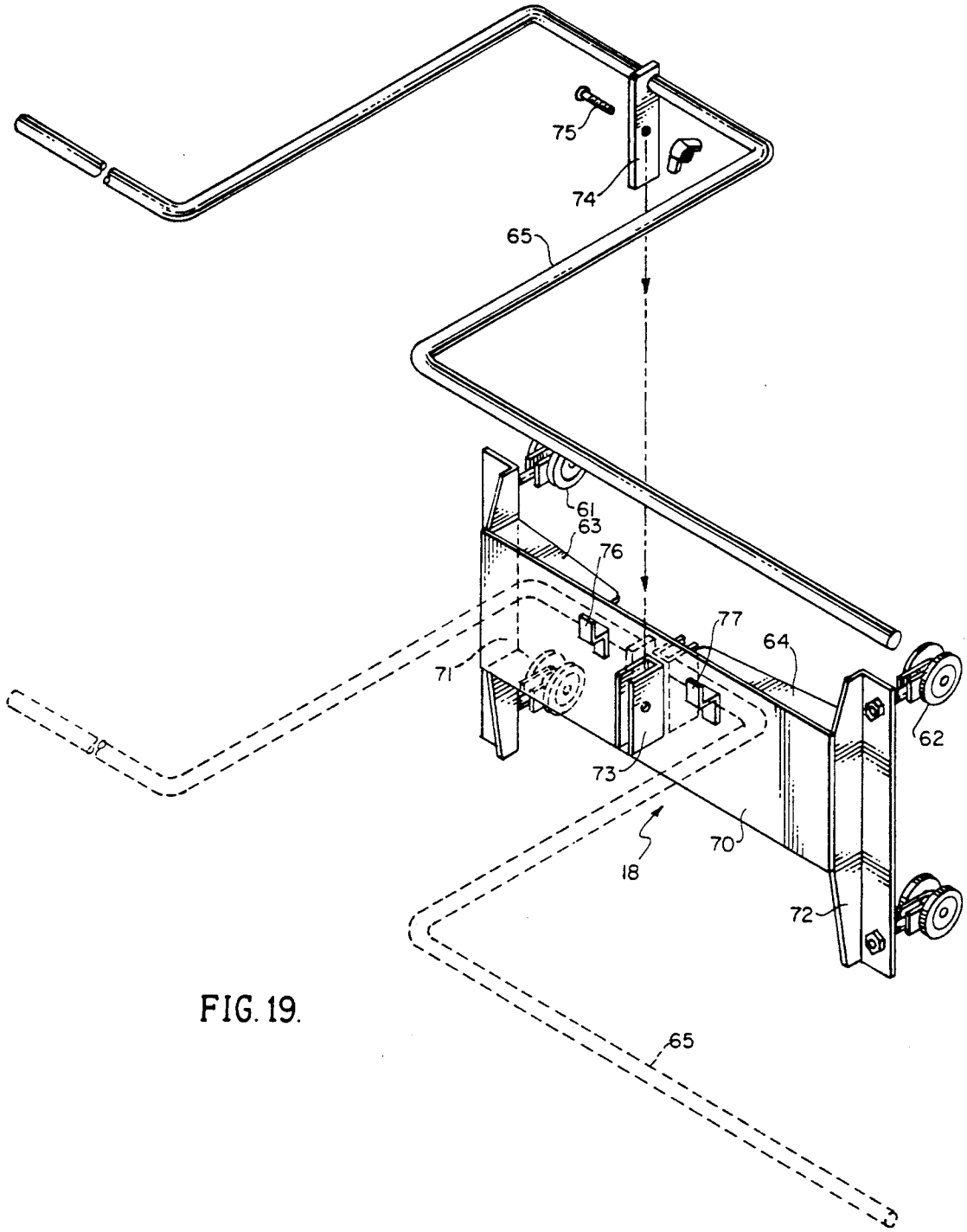
FIG. 19 is a front exploded view of the handle bar and carriage arrangement.

Referring now in detail to FIG. 19, the details of the carriage, handle bar and rollers are more clearly illustrated wherein it can be seen that the carriage 18 includes a platform 70 having outside members 71 and 72 on which the respective wheels, such as wheels 61 and 62 are carried. The handle bar 65 is attached to the platform 70 by means of a yoke member 73 which receives a mounting bar 74 between its opposite sides and a fastener, such as fastener 75, secures the bar 74 to the yoke 73. The handle bar 65 is supported on the platform 70 by means of mounts 76 and 77 which are arranged on opposite sides of the yoke 73.

In view of the foregoing, it can be seen that a variety of body exercises may be performed utilizing the exercise equipment of the present invention. Such exercises may tone or increase the size of torso muscles, arm muscles, leg muscles and the like. The device is unitary in construction and accepts certain alternate equipment such as the carriage 18 or the hand grip 21 as the exercise may dictate. As illustrated in FIG. 1, no ancillary equipment is even needed since a substantial number of muscles can be exercised by merely gripping the cord or cable 15.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A home gym body-building device of the anaerobic type capable of exercising upper, middle and lower parts of the body essentially consisting of the combination of:

a selective mobile base having two portions foldable with respect to each other into operative positions respectively, said mobile base comprising a first supporting means including a bottom surface and side edges perpendicular to said bottom surface;

a frame including a first end intermediately connected to the base, said frame further including a second supporting means at a second end;

said first and second supporting means are adapted so that when said device is in a first operative formation said bottom surface of said first supporting means contacts a horizontal supporting surface and said second supporting means is inoperative, and when said device is in a second operative formation one of said side edges of the first supporting means and said second supporting means contact the horizontal supporting surface;

a single endless cable movably carried on said frame comprising a resilient tube enclosing a load-bearing chain;

adjustable mechanical tension means operably connected with said single endless cable for placing a resistance load thereon;

a pair of spaced-apart pulleys rotatably mounted on said frame in frictional contact with said single endless cable;

a carriage movably mounted on said frame between said pulleys and releasably engageable with said single cable via said tube so as to move in unison therewith against said resistance load;

handles carried on said carriage; and said tension means includes friction pads movably engageable with a selected one of said pulleys adapted to regulate tension on said cable.

* * * * *